US005861716A

United States Patent [19]

Ogura

[11] Patent Number: 5,861,716

[45] Date of Patent: Jan. 19, 1999

[54] MAGNETRON HAVING A CATHODE MOUNT WITH A GROOVED RECESS FOR SECURELY RECEIVING A CATHODE FILAMENT

[75] Inventor: Toshio Ogura, Mobara, Japan

[73] Assignees: Hitachi, Ltd., Tokyo; Hitachi Electronic Devices Co., Ltd., Mobara, both of Japan

[21] Appl. No.: 600,732

[22] Filed: Feb. 13, 1996

[30] Foreign Application Priority Data

Feb. 20, 1995 [JP] Japan ..... 7-030752

[51] Int. Cl.[6] ..... H01J 25/50; H01J 23/05

[52] U.S. Cl. ..... 315/39.51; 313/341; 313/344

[58] Field of Search ..... 315/39.51, 39.63, 315/39.67; 313/341, 344

[56] References Cited

U.S. PATENT DOCUMENTS 4,705,989 11/1987 Takada et al. ..... 315/39.75 X

FOREIGN PATENT DOCUMENTS

| | | | |
|---|---|---|---|
| 58-204436 | 11/1983 | Japan | 313/344 |
| 62-208527 | 9/1987 | Japan | 315/39.51 |
| 63-10429 | 1/1988 | Japan | 315/39.51 |
| 63-226851 | 9/1988 | Japan | 315/39.51 |
| 1309234 | 12/1989 | Japan | 315/39.51 |
| 75130 | 3/1990 | Japan | 315/39.51 |

*Primary Examiner*—Benny T. Lee

*Attorney, Agent, or Firm*—Antonelli, Terry, Stout & Kraus, LLP

[57] ABSTRACT

A magnetron includes a cathode mount having a directly heated helical cathode filament for emitting thermoelectrons, an upper end shield and a lower end shield disposed so as to support the filament at upper and lower ends thereof, and center and side leads holding the upper and lower end shields respectively. The lower end shield is formed with a recess for housing the lower end of the directly heated helical cathode filament in the upper surface thereof, at least a portion of the inner wall of the recess is sloped, and a groove is formed at the peripheral edge of the bottom of the recess.

11 Claims, 10 Drawing Sheets

MAGNETRON HAVING A CATHODE MOUNT WITH A GROOVED RECESS FOR SECURELY RECEIVING A CATHODE FILAMENT

The present invention relates to a magnetron and particularly to a magnetron having a new structure for connecting a filament to a lower end shield for supporting the filament in a cathode mount thereof.

A magnetron can generate microwave frequency powers efficiently, and is widely used in radar applications, medical applications, cooking appliances such as a microwave oven, and other microwave applications.

FIG. 9 is a cross sectional view illustrating an example of a conventional magnetron structure. Numeral 1 indicates a filament, 2 and 2' are anode vanes, 3 is an anode cylinder, 4 and 4' are permanent magnets, 5 and 5' are pole pieces, 6 and 6' are yokes, 7 is an antenna lead, 8 is an antenna, 9 is an exhaust tube, 10 is an antenna cover, 21 is an upper end shield, 22 is a lower end shield, 23 and 24 are cathode leads (23 indicates a center lead and 24 indicates a side lead), 25 is an input side ceramic, 26 are terminal plates, 27 are heater leads, 31 are choke coils, 32 is a feed-through capacitor, 33 is a filter case, 34 is a lid, and 45 are cooling fins.

In the figure, ten anode vanes 2 and 2' are soldered to the anode cylinder 3 around the helical cathode filament 1 or press-formed integrally with the anode cylinder.

The pole pieces 5 and 5' made of a ferromagnetic substance such as soft iron and the annular permanent magnets 4 and 4' are located above and below the anode cylinder 3, respectively.

Magnetic fluxes generated from the permanent magnets 4 and 4' enter an interaction space formed between the cathode filament 1 and the anode vanes 2 and 2' via the pole pieces 5 and 5' and provide a required axial DC magnetic field.

The yokes 6 and 6' form a magnetic circuit for the magnetic fluxes from the permanent magnets 4 and 4' in combination with the permanent magnets 4 and 4', and the pole pieces 5 and 5'.

Electrons emitted from the cathode filament 1 at a negative high potential generate a microwave electric field at each anode vane 2 and 2' by making a circular motion under the action of the electric and magnetic fields.

The generated microwave electric fields reach the antenna 8 via the antenna lead 7 and are outputted to an external device from the antenna cover 10.

The cathode filament 1 is generally made of a tungsten wire containing about 10% of thorium oxide ($Tho_2$) to provide the electron emission characteristic and workability and is supported by the upper end shield 21, the lower end shield 22, and the cathode leads 23 and 24.

The cathode leads 23 and 24 are generally made of molybdenum (Mo) to provide the heat resistance and workability and are connected to the heater leads 27 which in turn are connected to the choke coils 31, by the terminal plate 26 brazed as by silver solder on the top of the input side ceramic 25.

A filter structure comprising the filter case 33 housing the choke coils 31 and the feed-through capacitor 32 and the lid 34 for closing the opening of the filter case is attached at the lower part of the magnetron.

The choke coils 31 connected to the heater leads 27 constitute an L-C filter with the feed-through capacitor 32 and suppress the low frequency components propagated through the cathode leads. The microwave frequency components are shielded by the filter case 33 and the lid 34 thereof.

The cooling fins 45 fitted around the anode cylinder 3 radiate heat generated by the operation of the magnetron.

FIG. 10 is a plan view illustrating the anode structure of the conventional magnetron shown in FIG. 9 and the same numeral is assigned to each same part as that shown in FIG. 9.

In the figure, the anode vanes comprise two sets of anode vanes 2 and 2' arranged alternately, respectively, and these anode vanes 2 and 2' are extended radially inwardly from the inner wall of the anode cylinder 3.

A pair of annular members differing in diameter from each other, i.e. a first strap ring 61 and a second strap ring 62, are connected to the alternate vanes 2 and the intervening vanes 2', respectively, at each of the upper axial end side thereof, i.e. the side thereof connected to the antenna lead 7 and the lower axial end side thereof, i.e. the side thereof facing the ends of the cathode leads 23, 24 fixed to the vacuum envelope, as shown in FIG. 9.

FIGS. 11A and 11B are illustrations of the strap rings shown in FIG. 10. FIG. 11A shows a plan view and a cross-sectional view of the first strap ring 61 having a smaller diameter and FIG. 11B shows a plan view and a cross-sectional view of the second strap ring 62 having a larger diameter. The strap rings are connected to the anode vanes at projections 61*a* (FIG. 11A) or 62*a* (FIG. 11B) formed on the inner periphery or the outer periphery thereof.

FIG. 12 is a cross sectional view of the anode structure of the conventional magnetron taken along the section line I—I in FIG. 10. The anode vanes 2 and 2' are connected to the strap rings 61 and 62, respectively, at the upper axial ends thereof and to the strap rings 61' and 62' which are the same as the strap rings 61 and 62, respectively, at the lower axial ends thereof.

A structure of the above-mentioned kind of magnetron is disclosed in Japanese Utility Model Publications Sho 57-56504 and Sho 63-25656, for example.

In the magnetron of the prior art, to decrease the amount of oxygen free copper used and to save material, the anode structure is miniaturized by reducing the number of anode vanes from 12 to 10 and making the anode cylinder smaller in diameter and-shorter in length at the same time.

Corresponding to miniaturization of the anode structure, the cathode mount is also miniaturized by decreasing the winding diameter of the filament and the outer diameters of the upper and lower end shields.

A proposal of further reducing the number of anode vanes to 8 has been made recently, and correspondingly, the winding diameter of the filament and the outer diameters of the upper and lower end shields have been further reduced.

In this miniaturized cathode structure, it is considerably difficult to connect and fix the upper and lower end shields to the filament.

FIG. 13 is an illustration of the conventional process for connecting the lower end shield and the filament. The reference numerals used in FIG. 13 are the same as those used in FIG. 9. In addition, reference numeral 101 indicates a syringe, 102 is a dispenser, 103 is a nozzle, and 104 is Mo (molybdenum) solder paste.

In FIG. 13, the solder 104 contained in the syringe 101 is supplied to the nozzle 103 by an intended amount by the dispenser 102. The tip of the nozzle 103 is placed in contact with, or in proximity to, the inner wall of the recess of the lower end shield 22 housing the lower end of the filament 1, injects and coats the solder 104 in the recess with the cathode mount being rotated.

After the solder 104 is coated, the lower end of the filament 1 is inserted into the recess, and the solder is melted by heating the region of the lower end shield 22 by radio frequency heating, and the filament 1 and the lower end shield 22 are thereby connected.

The lower end shield 22 has a recess for housing the lower end of the filament 1 and a central opening for passing through the cathode lead 24 to be connected to the upper end shield 21. Ru-Mo solder paste is injected into the recess of the lower end c shield 22 with the cathode lead 24 being inserted into the central opening, but without the lower end of the filament 1 being set in the recess. Subsequently, the lower end of the filament 1 is inserted into the recess, connected and fixed to the lower end shield 22 by heating and melting the solder paste.

A problem arises that if the amount of Ru-Mo solder paste injected into the recess of the lower end shield is insufficient, a defective connection occurs, and conversely if the amount is excessive, the solder comes in contact with or is connected to the cathode lead 24 passing through the central opening, resulting in short-circuit between the cathode leads 23 and 24. Therefore, control of the work for injecting the solder has proven to be extremely difficult.

A method for connecting the lower end shield and the filament by welding is disclosed in Japanese Patent Application Laid-Open Hei 2-61937, and a method by pelletizing powder of tungsten (W) or molybdenum (Mo), placing it in the recess of the lower end shield, and connecting them by melting the powder by radio frequency heating is disclosed in Japanese Patent Application Laid-Open Hei 2-10624. However, in terms of material cost, the aforementioned method for coating the solder paste in the recess of the lower end shield and heating them by radio frequency is most advantageous.

SUMMARY OF THE INVENTION

An object of the present invention is to solve the problems of the prior art mentioned by providing a magnetron having a cathode mount for facilitating application of the solder on the lower end shield for fixing the filament to the lower end shield, and for preventing short-circuit between the cathode leads in miniaturization of a magnetron by reducing the number of anode vanes to not only ten but also eight.

To accomplish the above object, according to the present invention, a magnetron includes a cathode mount comprising a directly heated helical filament for emitting thermoelectrons, an upper end shield and a lower end shield disposed so as to support the directly heated helical filament at the upper and lower ends thereof respectively, and a center lead and a side lead holding the upper and lower end shields respectively, the lower end shield is formed with a recess for housing the lower end of the directly heated helical filament in the upper surface thereof, at least a portion of the inner wall of the recess is sloped, and a groove is formed at the peripheral edge of the bottom of the recess.

The slope of the inner wall of the recess is not limited to planar, it may be convex, concave, or the shape of a staircase, and the section of the groove may be V-shaped, U-shaped, rectangular, or of a suitable profile.

According to the present invention having the aforementioned constitution, when the lower end of the filament is inserted into the recess formed in the lower end shield, and the tip of the nozzle is positioned close to or in contact with the slope of the inner wall of the recess, and injects the solder into the recess, the solder flows on the slope of the inner wall of the recess and is coated in the recess wetting the lower part of the filament.

Surplus solder is collected in the groove formed at the peripheral edge of the bottom of the recess and prevented from overflowing from the edge of the central opening of the lower end shield passing the cathode lead (center lead) and from forming a short-circuit with the center lead passing through the central opening.

By doing this, sufficient solder for connection of the filament is secured in the recess and the filament is fixed to the lower end shield firmly.

Conversely, the solder is injected into the recess of the lower end shield, then the lower end of the filament may be inserted into the recess.

BRIEF DESCRIPTION OF THE DRAWINGS

Like reference numerals designate like parts throughout the following figures.

DETAILED DESCRIPTION OF THE PREFERRED EMBODIMENTS

The embodiments of the present invention will be explained hereunder with reference to the accompanying drawings.

Figure 1A:
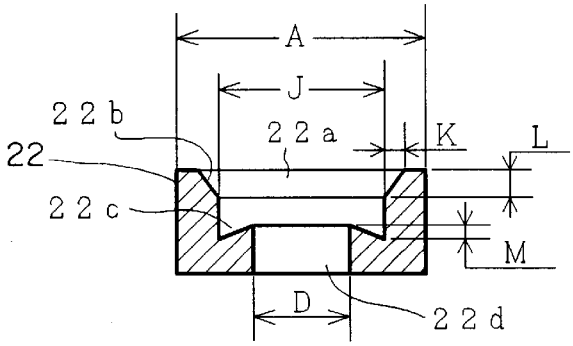
FIG. 1A is a cross sectional view of a lower end shield used for a cathode mount of an embodiment of the magnetron of the present invention.
Figure 1B:
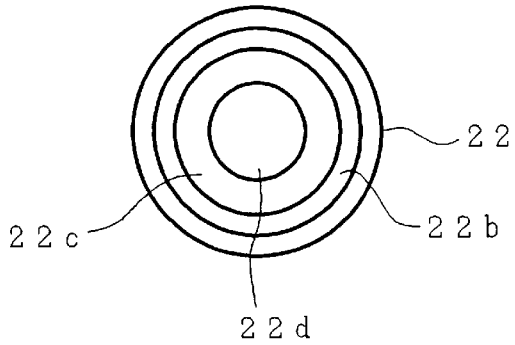
FIG. 1B is a top view thereof.

FIGS. 1A and 1B are illustrations of a lower end shield used for a cathode mount of an embodiment of the magnetron of the present invention, with FIG. 1A being a cross sectional view and FIG. 1B being a top view thereof.

In these figures, reference numeral 22 indicates a lower end shield, 22*a* is a recess, 22*b* is a truncated cone, 22*c* is a V-groove, and 22*d* is a central opening passing a cathode lead.

As shown in FIG. 1A, the lower end shield 22 is about 5.5 to 6.5 mm in an outer diameter A, and is formed with the recess 22*a* having a depth capable of accommodating 0.5 to 1.5 turns of the lower end of a filament having an outer diameter F (see FIG. 3) of about 2.6 to 3.2 mm and a diameter J larger by about 0.05 to 0.2 mm than the outer diameter F of the filament and the central opening 22*d* having diameter D of about 2.0 mm for passing a cathode lead (center lead) of about 1.45 mm in a diameter C (see FIG. 3) connected to an upper end shield.

In the inner wall of the recess 22*a,* the truncated cone portion 22*b* is formed by chamferring the inner wall of the recess with dimensions K and L (see FIG. 1A) being about 0.5 to 1.0 mm, and at the peripheral edge of the bottom of the recess 22*a* the V-groove 22*c* is formed with a depth M of about 0.5 mm.

The clearance between the outside diameter of the center lead and the central opening 22*d* in the lower end shield 22 is about 0.3 mm. Solder is injected onto the truncated cone 22*b,* with the lower end of the filament inserted in the lower end shield 22.

With this structure of the lower end shield, the solder will not extrude into the central opening 22*d* and will be prevented from forming a short circuit with the cathode lead (center lead) passing through the central opening 22*d.*

The numerical values mentioned above are merely illustrative, and they can be changed suitably depending on the output capacity of the magnetron.

Figure 14:
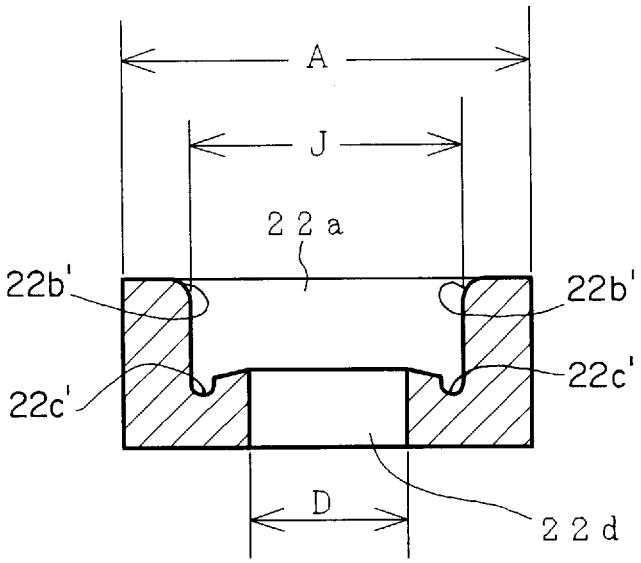
FIG. 14 is a cross sectional view of a lower end shield used for a cathode mount of another embodiment of the magnetron of the present invention.

The slope of the upper wall of the recess is not limited to being planar 22*b* in cross section as shown in FIG. 1A, but may be convex 22*b'* in cross section as shown in FIG. 14, the slope being adjacent to the top of the cross section of the staircase shape, and the section of the groove may be V-shaped 22*c* as shown in FIG. 1A, U-shaped 22*c'* as shown in FIG. 14, rectangular, or of a suitable profile.

Figure 2:
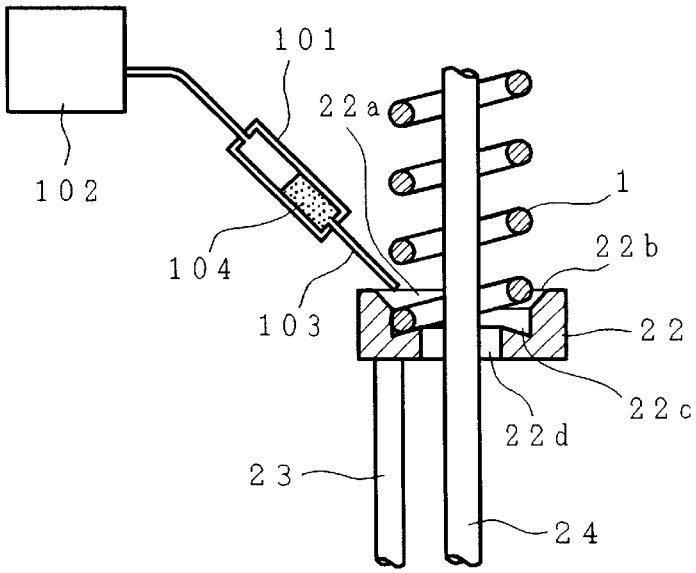
FIG. 2 illustrates assembly of a cathode mount of an embodiment of the magnetron of the present invention.

FIG. 2 illustrates assembling of a cathode mount of an embodiment of the magnetron of the present invention. Reference numeral 1 indicates a filament, 23 is a cathode lead connected to the lower end shield 22, 24 is a cathode lead connected to the upper end shield (not shown), 101 is a syringe, 102 is a dispenser, 103 is a nozzle, and 104 is Mo solder paste, and each same numeral as that shown in FIGS. 1 and 9 corresponds to the same part as in FIGS. 1 and 9.

In the above-noted figure, the lower end shield 22 has the recess 22*a* housing the lower end of the filament 1 and the central opening 22*d* for passing the cathode lead 24 to be connected to the upper end shield 21. The lower end of the filament 1 is set in the recess 22*a* with the cathode lead 24 inserted into the central opening 22*d.*

The Ru-Mo solder paste 104 is injected into the recess 22*a* of the lower end shield 22, and is heated and melted to connect and fix the filament 1 to the lower end shield 22.

Figure 13:
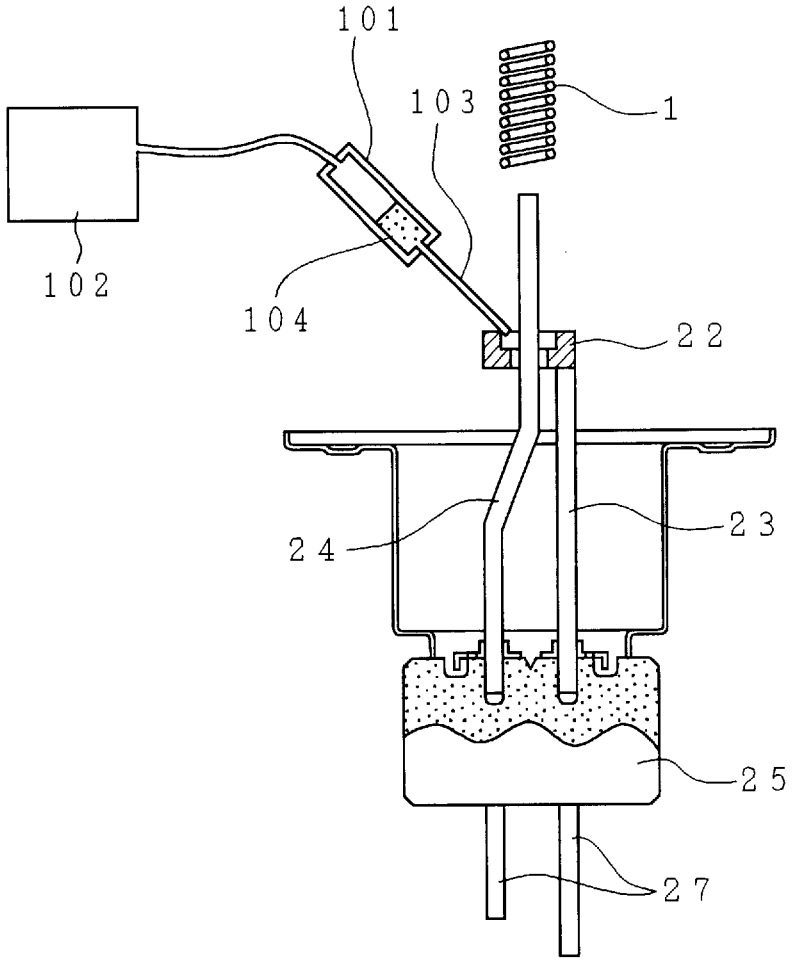
FIG. 13 (PRIOR ART)
FIG. 13 illustrates the conventional connection work for the lower end shield and the filament.

The solder is injected and coated as shown in FIG. 13. Namely, the solder 104 contained in the syringe 101 is supplied to the nozzle 103 by an intended amount by the dispenser 102. The tip of the nozzle 103 is placed in contact with, or close to, the slope of the truncated cone 22*b* of the recess 22*a* of the lower end shield 22 housing the lower end of the filament 1 and injects and coats the solder 104 in the recess 22*a* with the cathode mount being rotated.

After the solder 104 is coated, the coated solder is melted by heating the region of the lower end shield 22 by radio frequency and connects the filament 1 and the lower end shield 22.

Figure 3:
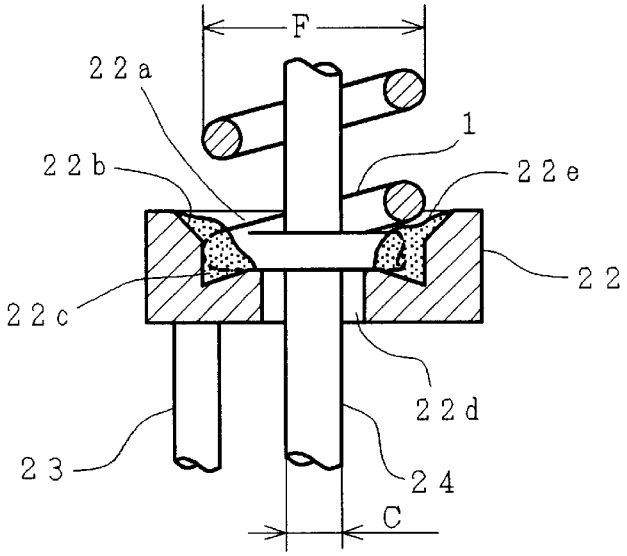
FIG. 3 is an enlarged partial cross sectional view showing the connection portion of the lower end shield and the filament of a cathode mount of an embodiment of the magnetron of the present invention.

FIG. 3 is an enlarged, partial cross sectional view of the connection portion of the lower end shield and the filament of a cathode mount of an embodiment of the magnetron of the present invention. Numeral 22*e* indicates solidified solder, and each numeral shown in FIG. 1 corresponds to the numerals in FIG. 1.

In FIG. 3, the solder 22*e,* injected, heated and solidified as explained in FIG. 2, fixes the 0.5 to 1.5 turns of the lower end of the filament 1 in the region between the slope of the truncated cone 22*b* and the V-groove 22*c.*

By doing this, the solder securely connects the filament 1 to the lower end shield and is prevented from extruding into the central opening 22*d* of the lower end shield 22 and from forming a short circuit with the cathode lead therethrough.

Figure 4:
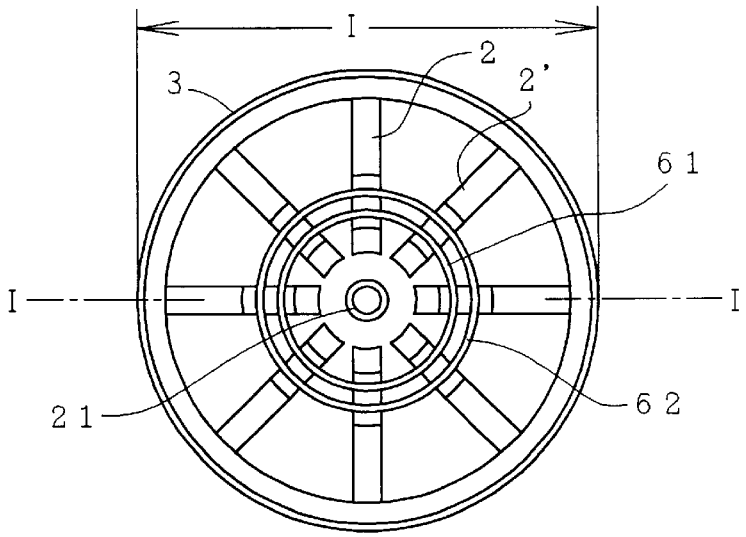
FIG. 4 is a schematic view of an essential section in proximity to the anode and the cathode illustrating another embodiment of the magnetron of the present invention.
Figure 5:
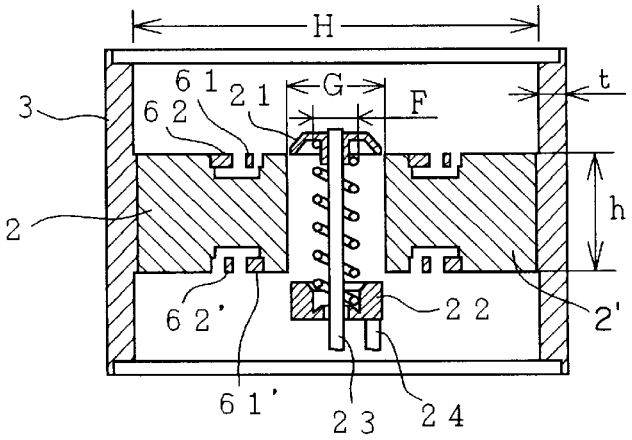
FIG. 5 is a schematic view of an essential section in proximity to the anode and the cathode taken along the Section line I—I in FIG. 4.

FIG. 4 is a schematic view of the essential section in proximity to the anode and the cathode of an embodiment of the magnetron incorporating a cathode mount of the present invention and FIG. 5 is a cross sectional view of the essential section in the neighborhood of the anode and the cathode taken along the section line I—I shown in FIG. 4. Reference numeral 1 (FIG. 3) indicates a cathode filament, 2, 2' and 2" anode vanes, 3 (FIGS. 4 and 5) an anode cylinder, 21 (FIGS. 4 and 5) an upper end shield, 22 (FIG. 5) a lower end shield, 23 and 24 (FIG. 5) cathode leads (23 indicates a center lead and 24 indicates a side lead), 61 (FIG. 4 and 5) and 61' (FIG. 5) first strap rings, and 62 (FIGS. 4 and 5) and 62' (FIG. 5) second strap rings.

In the figures, inside the anode cylinder 3 made of copper of 2.0 mm in thickness t, eight anode vanes 2 and 2' made of copper having a thickness of 2.0 mm and a height h of 8.0 mm are projecting radially inwardly and alternately connected at both the upper and lower axial ends thereof by the first strap rings 61 and 61' and the second strap rings 62 and 62' having a diameter different from that of the first strap rings 61 and 61'.

Furthermore, in the center of the anode cylinder 3. the cathode filament (directly heated helical cathode) 1 is disposed and both ends of the cathode filament are fixed to the output side end shield (upper end shield) 21 and the input side end shield (lower end shield) 22, respectively. The output and input side end shields are supported by the rod-like cathode support leads 23 and 24, respectively.

The dimensions of an example of a magnetron having eight vane anodes optimized to obtain satisfactory microwave stability are as follows:

F (outer diameter of a cathode filament)=2.8 mm

G (diameter of a circle tangent to radially inner ends of all vanes)=7.2 mm

H (inner diameter of an anode cylinder)=32 mm

I (outer diameter of an anode cylinder)=36 mm

The above values are just an example. As a result of various experiments, the ranges of dimensions practical for a magnetron for use in a microwave oven are shown below.

Figure 6:
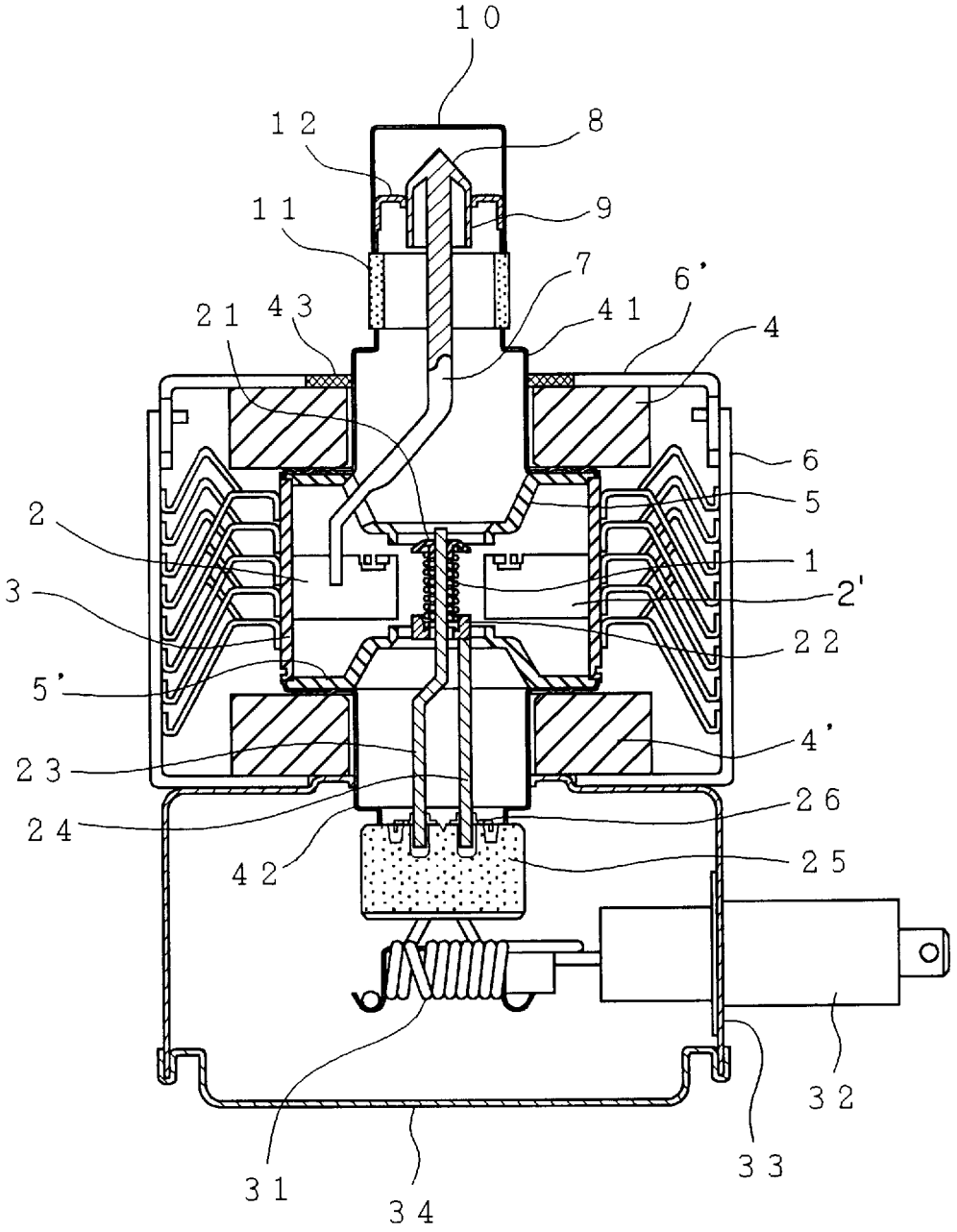
FIG. 6 is a cross sectional view illustrating another embodiment of the magnetron of the present invention.

The range of the ratio (F/G) of the outer diameter F of the cathode filament to the diameter G between the radially inner ends of vanes is shown below.

$$F/G=0.342 \text{ to } 0.40,$$

and the suitable ratio (H/G) of the inner diameter H of the anode cylinder to the diameter G between the radially inner ends of vanes is about 4.4 in view of stable oscillation and reduction of the diameter of the anode cylinder, as seen in FIG. 6.

The practical range for the ratio of F/G in an eight-vane magnetron depends on the degree of possible reduction of the outer diameter F of the cathode filament in view of fabrication.

In a magnetron for a microwave oven, a helical cathode made of thoriated tungsten is used to obtain satisfactory electron emission.

This helical cathode is fabricated by winding a thoriated tungsten wire around a mandrel having a diameter equal to the inner diameter of the cathode filament at an intended winding pitch under tension. Therefore, as the winding diameter, that is, the outer diameter F of the cathode filament decreases, the mandrel may be deformed or the filament wire may be cracked, resulting in poor mass productivity.

The aforementioned problems occur more frequent as the wire diameter increases. The wire diameter used for a cathode filament of a magnetron for a microwave oven of about 500 to 900 W output is about 0.5 mm and the experimental results on this wire diameter show that the outer diameter F of a filament has to be limited to between 2.6 and 3.2 mm.

Therefore, when F=2.8 mm is adopted, it was found by experiments that G=2.8/0.39=7.2 mm can provide a satisfactory microwave oscillation. It means that the oscillation stability and the oscillation efficiency by this magnetron attains the levels sufficiently practical for a microwave oven of from several hundreds W to less than 1 kW microwave output.

For these values of the diameter G of the vanes, it is necessary to limit the outside diameter of the lower end shield 22 for supporting the filament having an outside diameter of 2.6 to 3.2 mm, to 5.5 to 6.5 mm.

Considering also the thickness of the vanes, as the spacing between tips of adjacent anode vanes is narrowed, the high frequency electric field between these tips of the adjacent anode vanes becomes stronger and the stability against loads is improved. However, the spacing between tips of the adjacent anode vanes is 0.5 mm at a minimum in view of fabrication.

Assuming G=7.2 mm, the thickness of each anode vane is $(\pi\times7.2-0.5\times8)/8\approx2.3$ mm. In case of ten vanes, the thickness of each anode vane is 1.8 mm and the accumulated thickness of ten anode vanes is 18 mm. The accumulated thickness of eight vanes is 2.3×8=18.4 mm and the thermal design margin for anode vanes is equivalent to that of ten vanes.

The ISM band frequency allotted for a microwave oven magnetron is 2450±50 MHz and it is necessary that the magnetron oscillation spectrum is within this range.

The magnetron oscillation spectrum is of a multi-cavity resonance mode, so that it has a band width generated due to variations in each cavity resonance characteristic. It may be said that a magnetron of eight anode vanes having a smaller number of cavities is basically more advantageous and it has been proved by experiments.

Figure 9:
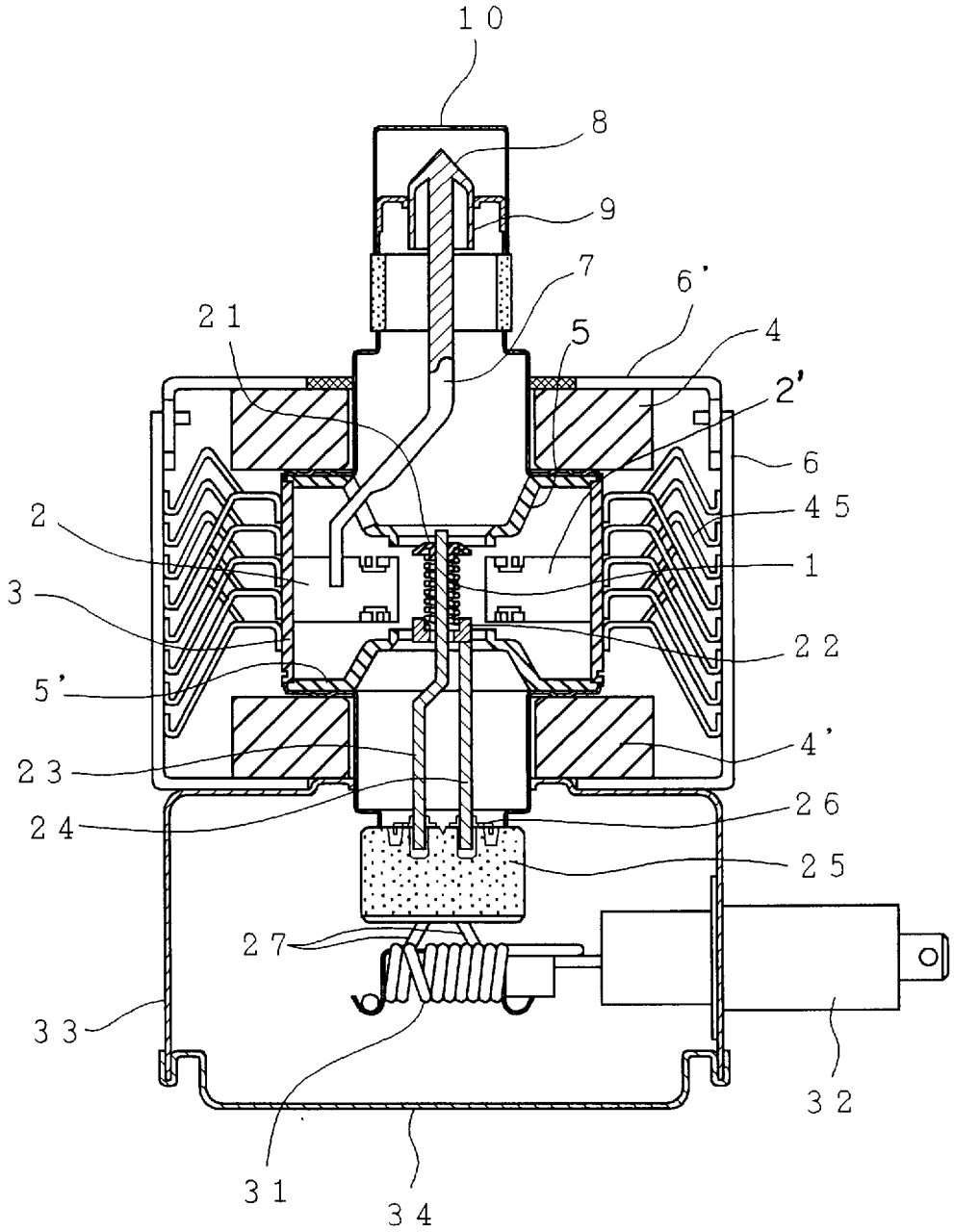
FIG. 9 (PRIOR ART)
FIG. 9 is a cross sectional view illustrating a structure of a conventional magnetron.
Figure 10:
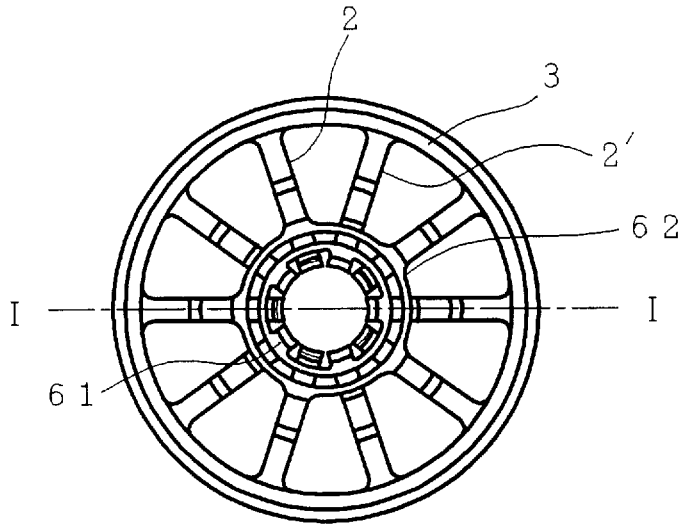
FIG. 10 (PRIOR ART)
FIG. 10 is a plan view illustrating the anode structure of a conventional magnetron.
Figure 11A:
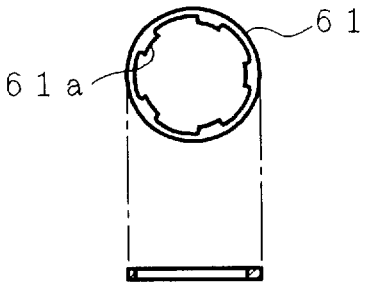
FIG. 11A (PRIOR ART)
FIG. 11A is a top view of a strap ring with a large diameter in the anode structure of a conventional magnetron.
Figure 11B:
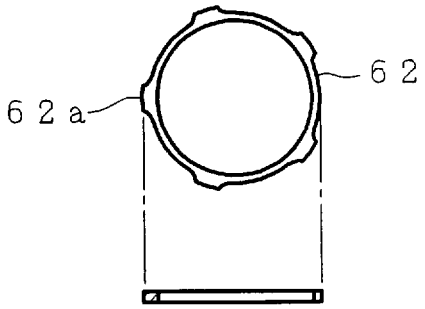
FIG. 11B (PRIOR ART)
FIG. 11B is a top view of a strap ring with a small diameter in the anode structure thereof.
Figure 12:
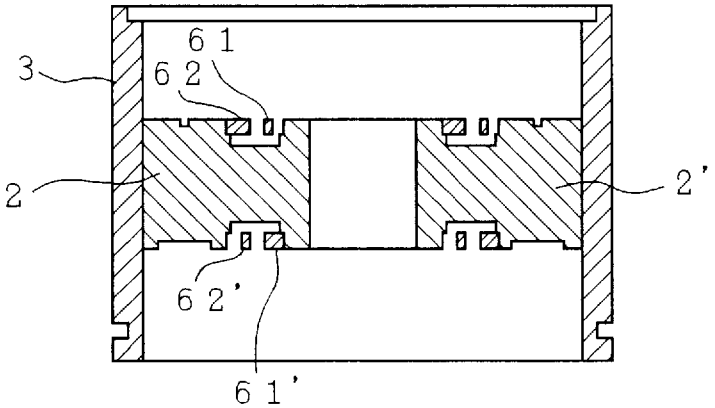
FIG. 12 is a cross sectional view of the magnetron of the present invention taken along the section line I—I in FIG. 6.

FIG. 6 is a cross-sectional view illustrating another embodiment of the magnetron employing the cathode shown in FIG. 1, wherein the same reference numerals as utilized in FIG. 9 designate corresponding parts in FIG. 6.

The magnetron in this embodiment has the cathode structure shown in FIG. 1, employs eight vanes 2 and 2' disposed in the anode cylinder 3, and first and second strap rings attached at the axial ends of the vanes on the side of the antenna lead 7 only. The other parts of the magnetron are basically the same as those shown in FIG. 9, so that explanation thereof will be omitted.

Figure 7A:
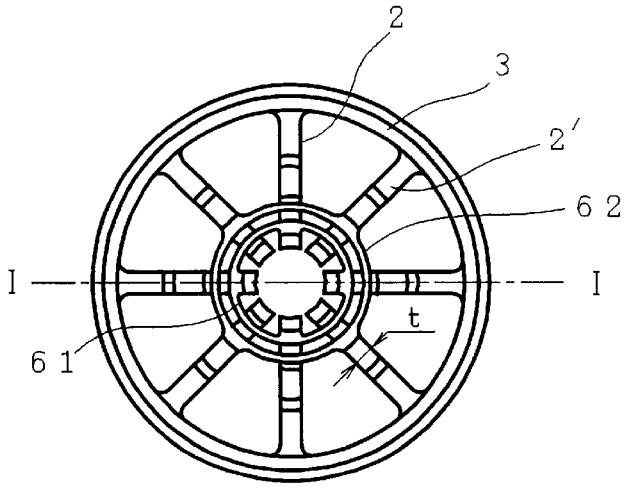
FIG. 7A is a top view of a constitution of the anode cylinder in the embodiment shown in FIG. 6.
Figure 7C:
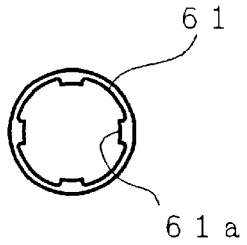
FIG. 7C is a top view of a strap ring with a small diameter.
Figure 7B:
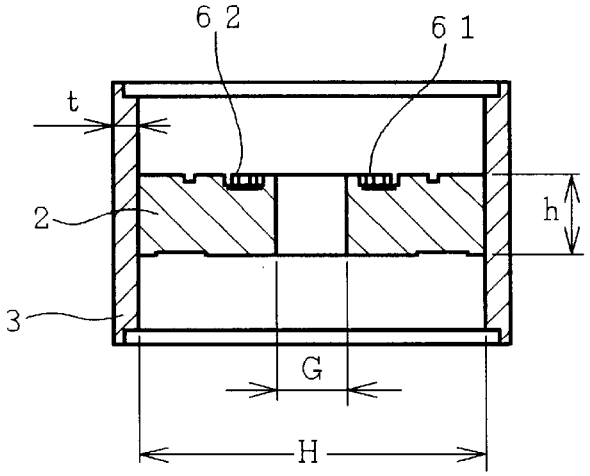
FIG. 7B is a cross sectional view thereof.
Figure 7D:
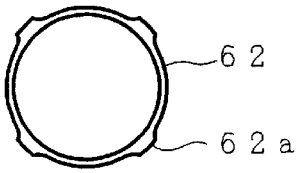
FIG. 7D is a top view of a strap ring with a large diameter.

FIGS. 7A, 7B, 7C, and 7D are illustrations of the anode cylinder in the embodiment shown in FIG. 6. FIG. 7A is a top view viewed from the antenna lead side, and FIG. 7B is a cross-sectional view along the section line I—I shown in FIG. 7A, and FIG. 7C is a top view of a first strap ring, and FIG. 7D is a top view of a second strap ring.

As shown in FIGS. 7A and 7B, the first strap ring 61 and the second strap ring 62 are attached to the upper axial ends of the anode vanes 2 and 2' only.

Therefore, it is suitable for reducing the axial length h (see FIG. 7B) of the vanes 2 and 2'.

Figure 8:
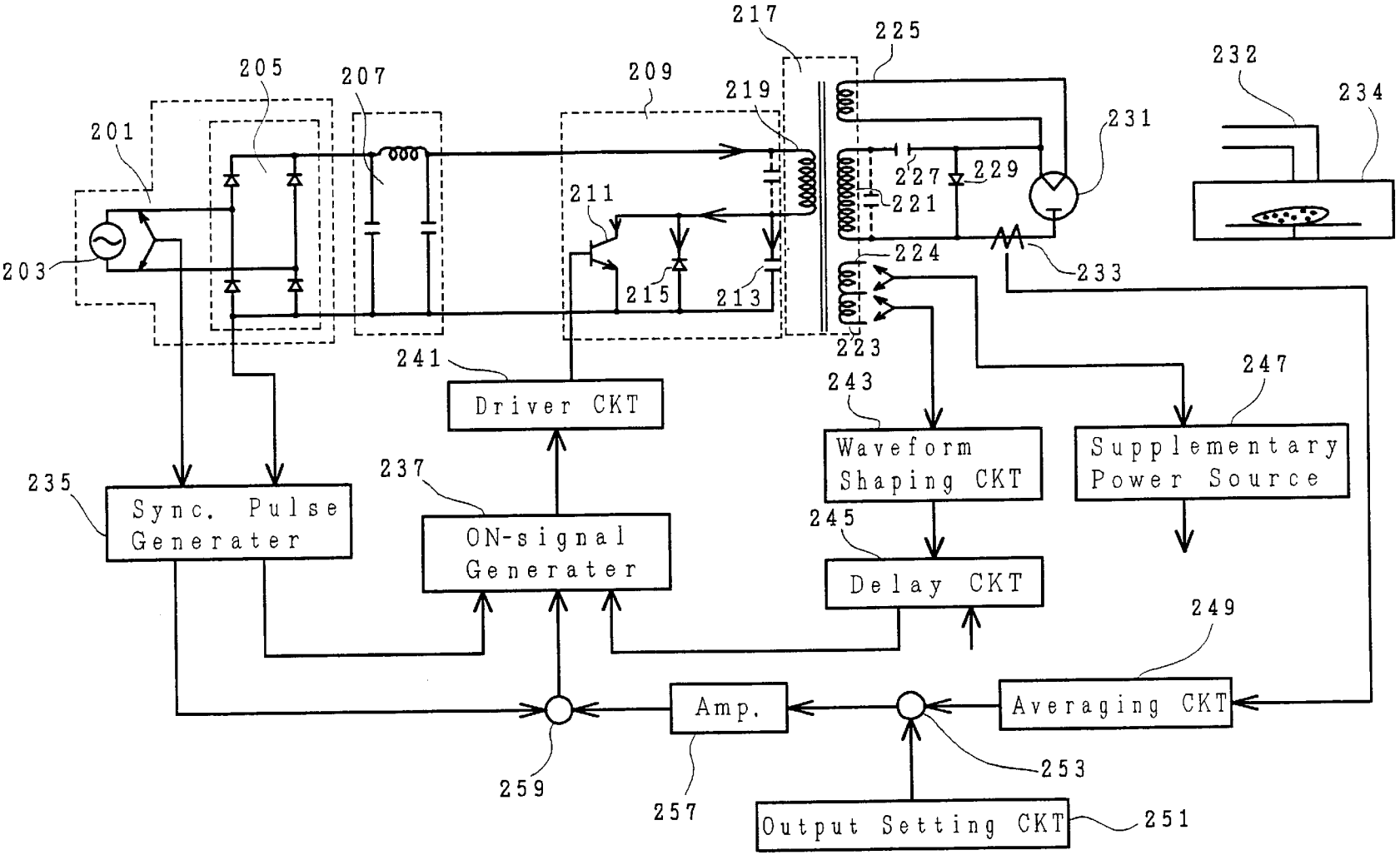
FIG. 8 is an illustration of a circuit of a microwave oven using the magnetron of the present invention.

FIG. 8 is an example of a circuit for a microwave oven using the magnetron of the present invention.

In the figure, reference numeral 231 indicates a magnetron and a DC power source 201 for supplying DC power to a switching power source 209 comprises a commercial AC power source 203 and a full-wave rectifier 205.

A filter 207 comprises a reactor and capacitors and is connected to the DC output terminals of the full-wave rectifier 205 for preventing high frequency noise included in an oscillation current of the magnetron 231 from leaking via the AC power source.

The switching power unit 209 is provided with a transistor 211 which is turned on or off by a driver circuit 241 driven by an ON signal from an ON-signal generator 237 which is controlled by a synchronizing pulse generated by a synchronizing pulse generator 235.

The switching power unit 209 includes a damper diode 215 connected in parallel with the transistor 211 in the opposite polarity and a resonance capacitor 213 connected in parallel with the transistor 211. The switching power unit 209 is connected to a step-up transformer 217 having a primary winding 219 and secondary windings 221, 223, 224, and 225. The primary winding 219 is connected to the filter 207 via the switching power unit 209, and forms a series resonance circuit with the capacitor 213.

The secondary winding 221 is connected to the magnetron 231 via a voltage-doubling rectifier comprising a capacitor 227 and a high-voltage diode 229. A load current flowing in the magnetron 231 is detected by a current detector 233 and is averaged by an averaging circuit 249. A difference between the averaged load current and a preset value from an output setting circuit 251 is provided by circuit 253 and is supplied to the ON-signal generator 237 as a control signal after being amplified in an amplifier 257 and being combined in circuit 259 with a synchronizing pulse from the synchronizing pulse generator 235.

The secondary winding 225 is for heating the filament of the magnetron 231. The secondary winding 223 supplies a voltage for output feedback which is shaped by a waveform shaping circuit 243, then delayed by an intended time by a delay circuit 245, and supplied to the ON-signal generator 237 as a control signal.

The current of the secondary winding 224 is supplied to a supplementary power source 247 and rectified and used as a power source for the control circuit and others.

A high voltage of about several KV is generally applied between the filament and the anode of the magnetron 231.

In the figure, reference numeral 232 indicates a wave guide and 234 a cooking chamber of a microwave oven. A microwave oscillated by the magnetron 231 is supplied to the cooking chamber 234 via the wave guide 232 and heats an object to be heated placed in the cooking chamber.

As mentioned above, in the magnetron of this embodiment, the lower end shield and the lower end of the cathode filament are securely connected to each other while there is prevented short-circuiting between the lower end shield and the cathode lead passing through the lower end shield for supporting the upper end of the cathode filament. Thus difficulties in assembling a miniaturized magnetron with the reduced number of anode vanes is overcome, resulting in a high performance magnetron application.

As explained above, according to the present invention, the lower end shield and the cathode filament can be securely connected to each other while maintaining accuracy in the assembly of the cathode mount in the miniaturized magnetron and a short circuit between the lower end shield and the cathode lead therethrough can be prevented.

By using this cathode mount, a miniature high performance magnetron can be obtained and provided various high performance microwave applications employing the magnetron.

What is claimed is:

1. A magnetron apparatus comprising:

a directly heated helical filament for emitting thermoelectrons;

an upper end shield and a lower end shield disposed so as to support said directly heated helical filament at an upper end and a lower end thereof, respectively;

a center lead passing through said lower end shield and said filament and being fixed to said upper end shield; and a side lead adjacent to said center lead and fixed to said lower end shield;

wherein said lower end shield includes an opening through which said center lead passes and a recess for housing and supporting a lower end of said directly heated helical filament, at least an upper portion of an inner wall of said recess of said lower end shield being sloped, and a groove being provided at a peripheral edge of a bottom of said recess of said lower end shield adjacent a lower portion of the inner wall of said recess.

2. A magnetron apparatus according to claim 1, wherein said directly heated helical filament housed in said recess of said lower end shield is fixed by Ru-Mo solder disposed in a truncated cone portion defined by said sloped portion of said inner wall and in said groove.

3. A magnetron apparatus according to claim 1, wherein a longitudinal cross-section of said sloped portion is linear.

4. A magnetron apparatus according to claim 1, wherein a longitudinal cross-section of said sloped portion is curved.

5. A magnetron apparatus according to claim 1, wherein said groove has a V-shaped longitudinal cross section.

6. A magnetron apparatus according to claim 1, wherein said groove has a U-shaped longitudinal cross section.

7. A magnetron apparatus according to claim 1, wherein a clearance between an outside diameter of said filament in a transverse cross-section thereof and an inside diameter of a right-circular-cylindrical portion of the inner wall of said recess in a transverse cross-section thereof is within a range from 0.05 to 0.2 mm.

8. A magnetron apparatus according to claim 1, further comprising:

an anode cylinder;

a plurality of vanes extending radially inward from said anode cylinder; and an antenna electrically connected to one of said plurality of vanes.

9. A magnetron apparatus according to claim 8, wherein said directly heated helical filament is a cathode filament which extends along a center axis of said anode cylinder, said cathode filament deforms an annular interaction space which extends between said cathode filament and said plurality of vanes.

10. A magnetron apparatus according to claim 9, further comprising:

a pair of pole pieces positioned at two axial ends of the annular interaction space for shaping an axial static magnetic field produced therein; and a pair of permanent magnets positioned outside said pair of pole pieces and outside said anode cylinder.

11. A magnetron apparatus according to claim 1, wherein said groove is configured and disposed adjacent the lower portion of the inner wall of said recess so that solder provided in the recess for retaining the lower end of said directly heated helical filament in said lower end shield does not extrude into the opening of said lower end shield through which said center lead passes and thereby preventing a short-circuit with said center lead and said filament.

* * * * *